US006356733B1

(12) United States Patent
Hino et al.

(10) Patent No.: US 6,356,733 B1
(45) Date of Patent: Mar. 12, 2002

(54) IMAGE FORMING APPARATUS, IMAGE FORMING METHOD AND PAPER TRANSFERRING APPARATUS

(75) Inventors: Hideki Hino, Toyokawa; Kazuo Okunishi, Okazaki; Kentaro Nagatani; Atsushi Kawai, both of Toyokawa; Koji Shakushi; Yoshiaki Takano, both of Toyohashi, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/532,090

(22) Filed: Mar. 21, 2000

(30) Foreign Application Priority Data

Mar. 25, 1999 (JP) ..... 11-081042
Oct. 4, 1999 (JP) ..... 11-283212

(51) Int. Cl.[7] ..... G03G 15/00
(52) U.S. Cl. ..... 399/303; 399/101; 399/401
(58) Field of Search ..... 399/401, 402, 399/302, 303, 304, 305, 299, 312, 313, 101; 271/291, 301

(56) References Cited

U.S. PATENT DOCUMENTS 5,765,074 A 6/1998 Yasui et al.
5,837,408 A 11/1998 Parker et al.

FOREIGN PATENT DOCUMENTS

JP 1-44457 * 2/1989
JP 10-142845 * 5/1998

* cited by examiner

*Primary Examiner*—Joan Pendegrass
(74) *Attorney, Agent, or Firm*—McDermott, Will & Emery

(57) ABSTRACT

An image forming apparatus includes a transferring device equipped with an endless rotating member for transferring a recording sheet while holding the recording sheet on a surface of the rotating member by rotating the rotating member. This transferring device has a first position, a second position and a third position in this order along a rotation path of the rotating member. Furthermore, the image forming apparatus includes an image forming portion for forming an image on the recording sheet being transferred from the first position to the second position by the transferring device, the image forming portion being provided between the first position and the second position so as to face the transferring device, and an inverting portion for receiving the recording sheet having an image formed by the image forming portion and transferred to the second position by the transferring device, inverting the recording sheet, and feeding the inverted recording sheet to the transferring device at the third position.

3 Claims, 10 Drawing Sheets

IMAGE FORMING APPARATUS, IMAGE FORMING METHOD AND PAPER TRANSFERRING APPARATUS

This application claims priority to Japanese Patent Application Nos. H11(1999)-81042 filed on Mar. 25, 1999 and H11(1999)-283212 filed on Oct. 4, 1999, the disclosure of which is incorporated by reference in its entirety.

BACKGROUND OF THE INVENTION

1. Field of the Invention

The present invention relates to an image forming apparatus capable of forming an image on both sides of a recording sheet, such as an electrophotography type image forming apparatus, an electrostatic recording type image forming apparatus, or the like. More particularly, the present invention relates to an image forming apparatus preferably used as a color copying machine, a color printer, or the similar apparatus, equipped with an image-transfer belt or an image-transfer drum. The present invention further relates to a paper transferring apparatus used in an image forming method executed in an image forming apparatus or used for an image forming apparatus.

2. Description of Related Art

As shown in FIG. 10, in a Tandem-type color copying machine or the like, a recording paper supplied from one of paper-supply cassettes (trays) 101*a*, 101*b*, 101*c*, 101*d* by a paper-supply portion 101 is fed onto an endless image-transfer belt 105 by a timing roller 161. An image is formed on the recording sheet held and transported by the image-transfer belt 105 by an image forming portion 106. This image recording sheet transported by the image-transfer belt 105 is discharged to a recording sheet discharging portion 103 such as a sorter.

In some copying machines mentioned above, an inverting portion 109 is provided for inverting a recording sheet in order to form images on both sides of the recording sheet. In both-side image forming, the recording sheet on which an image is formed at one side thereof is transported from the image-transfer belt 105, and is inverted by the inverting portion 109. Thereafter, the inverted recording sheet is returned to the paper-supply side via a circulation path 110. Then, the recording sheet is again fed onto the image-transfer belt 105 by the timing roller 161 to form an image on the reverse side of the recording sheet.

However, in the aforementioned conventional color copying machine, in order to form images on both sides of the recording sheet, the recording sheet having an image formed at one side thereof transported from the image-transfer belt 105 is returned to the paper-supply side via the circulation path 110. Thus, it is required to provide the circulation path 110, which causes a large sized apparatus and a complicated structure, resulting in an increased manufacturing cost.

On the other hand, in the aforementioned Tandem type color copying machine which is equipped with an image-transfer belt and is capable of forming images on both sides of a paper as a recording sheet, it is known to provide a paper transferring apparatus equipped with a second absorbing device for absorbing a paper supplied from a paper supply-portion to an image-transfer belt and a first absorbing device for absorbing the paper having an image formed on one side thereof, which is inverted by an inverting portion, to the image-transfer belt in order to form an image on the reverse side thereof.

The aforementioned absorbing device supplies an electric current so as to pass through the paper, which causes electrostatic polarization of the paper and image-transfer belt. Thus, the paper is electrostatically absorbed by the image-transfer belt.

In a case where the image transfer-belt has a semiconductor characteristic (or a conductor characteristic), electric charges will leak as time passes to deteriorate the absorbing force.

However, in a conventional paper-transferring apparatus having a plurality of absorbing devices as mentioned above, the aforementioned leakage of the electric charges is not considered. As a result, the absorbing force will deteriorate during the transportation of the paper absorbed on the image-transfer belt by the upper stream side absorbing device before it reaches the downstream side absorbing device, resulting in a detachment of the paper from the image-transfer belt for the worst.

These problems occur not only in a paper transferring apparatus in which a paper is absorbed on and transferred by an image-transfer belt but also in a paper transferring apparatus in which a paper is absorbed on and transferred by an image-transfer drum.

SUMMARY OF THE INVENTION

It is an object of the present invention to provide an image forming apparatus which can assuredly form images on both sides of a recording sheet and is small in size and simple in structure.

It is another object of the present invention to provide an image forming method which is possible to execute in the aforementioned image forming apparatus.

It is still another object of the present invention to provide a paper transferring device which can keep enough absorbing force for holding a sheet, such as a recording sheet, absorbed and transported by a rotating member including an image-transfer belt and an image-transfer drum, until the sheet reaches the next absorbing means at the downstream side.

According to a first aspect of the present invention, an image forming apparatus, comprising:

a transferring device equipped with an endless rotating member for transferring a recording sheet while holding the recording sheet on a surface of the rotating member by rotating the rotating member, the transferring device having a first position, a second position and a third position in this order along a rotation path of the rotating member;

an image forming portion for forming an image on the recording sheet being transferred from the first position to the second position by the transferring device, the image forming portion being provided between the first position and the second position so as to face the transferring device; and an inverting portion for receiving the recording sheet having an image formed by the image forming portion and transferred to the second position by the transferring device, inverting the recording sheet, and feeding the inverted recording sheet to the transferring device at the third position.

In this image forming apparatus, after forming an image on one side of the recording sheet transferred from the first position to the second position by the transferring device, the recording sheet is inverted at the inverting portion and fed to the transferring device. Therefore, it is not required to provide a circulation path or the like for directly returning the recording sheet having the image on one side thereof to the first position, resulting in a reduction of parts of the apparatus.

According to a second aspect of the present invention, an image forming method for forming images on a first side of a recording sheet and a second side which is a reversed side of the first side, the method including the steps of:

a first transferring step for transferring the recording sheet from a first position to a second position on a rotation path of an endless rotating member while holding the recording sheet on a surface of the endless rotating member rotatably driven in a state that the second side is contacted and held on the surface of the endless rotating member;

a first image forming step for forming an image on the first side of the recording sheet being transferred from the first position to the second position at the first transferring step;

an inverting step for detaching the recording sheet having the image formed on the first side at the first image forming step from the rotating member at the second position, and inverting the recording sheet;

a holding step for feeding the recording sheet inverted at the inverting step to a third position on the rotation path of the rotating member, and holding the recording sheet on the rotating member with the first side contacted the surface of the rotating member;

a second transferring step for transferring the recording sheet held on the rotating member at the holding step from the third position to the first and second positions in accordance with a rotational movement of the rotating member; and a second image forming step for forming an image on the second side of the recording sheet being transferred from the first position to the second position at the second transferring step.

According to this image forming method, the recording sheet having an image on one side thereof is inverted, and the inverted recording sheet is held by the rotating member at the third position. Thereafter, the recording sheet is transferred to the first and second positions for forming an image on the other side of the recording sheet. Accordingly, it is not required to directly return the reversed recording sheet to the first position.

According to a third aspect of the present invention, a paper transferring device, comprising:

an endless rotating member;

a first absorbing device disposed on a rotation path of the rotating member for absorbing a sheet to the rotating member;

a second absorbing device for absorbing the sheet absorbed by the first absorbing device to the rotating member again on the rotation path, the second absorbing device being disposed at a downstream side of the first absorbing device; and a controller for adjusting absorbing force to be generated by the first absorbing device depending on a sheet transferring time required to transfer the sheet from the first absorbing device to the second absorbing device.

According to the paper transferring device, the absorbing force to be generated by the first absorbing device is controlled depending on a sheet transferring time required to transfer the sheet from the first absorbing device to the second absorbing device. Therefore, enough absorbing force can be maintained within the sheet transferring time, in other words, until the sheet reaches from the first absorbing device to the second absorbing device. As a result, a stable paper transferring can be performed.

Other objects and the features will be apparent from the following detailed description of the invention with reference to the attached drawings.

BRIEF DESCRIPTION OF THE INVENTION

The present invention will be more fully described and better understood from the following description, taken with the appended drawings, in which.

DETAILED DESCRIPTION OF THE PREFERRED EMBODIMENTS

Figure 1:
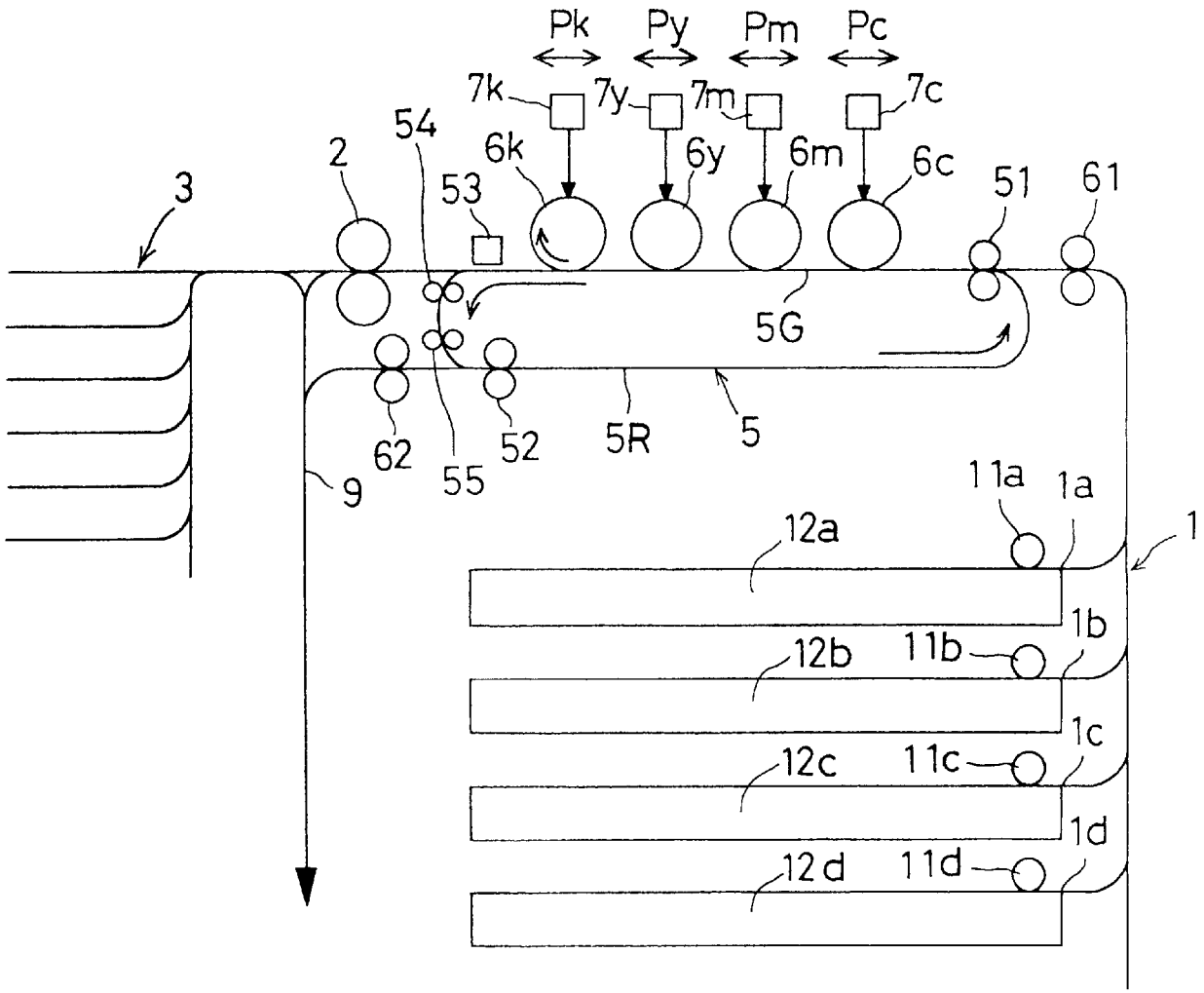
FIG. 1 is a schematic view of a major portion of an image forming portion of a full color image forming apparatus according to an embodiment of the present invention.

FIG. 1 is a schematic cross-sectional view showing a major part of an image forming portion of an electrophotography type full-color copying machine as an image forming apparatus according to one embodiment of the present invention.

As shown in FIG. 1, this image forming apparatus is a Tandem type apparatus equipped with four image forming portions Pc, Pm, Py, Pk. Disposed below the image forming portions is a paper-supply portion 1. At the left side of the image forming portions, a fixing device (fixing means) 2 is disposed. At the left side of the fixing device 2, a sorter 3 is disposed. The sorter 3 has functions such as stapling and tray-shifting.

Between the fixing device 2 and the sorter 3, a paper inverting portion 9 for inverting the paper is provided. The paper inverting portion 9 also serves as a changing device which changes a paper from being introduced into the return path region 5R of the image-transfer belt 5 for copying the reverse side of the paper into being discharged toward the sorter 3.

At a lower side of the paper transporting path between the paper-supply portion 1 and the fixing device 2, an endless image-transfer belt 5 for holding and transporting a paper is provided such that the belt is supported and tensioned by a plurality of rollers (not shown) in a well known manner.

The image-transfer belt 5 is made of a resin film sheet having semiconductor (or conductor) characteristics with opposite ends connected by melting, or the like, to create an endless belt. The belt 5 is endlessly driven at a constant velocity in the direction of the arrow by a driving roller(not shown).

The upper portion (image forming portion side) of the belt 5 constitutes a forward-path region 5G and the lower portion (paper-supply portion side) constitutes a return-path region 5R. The belt 5 holds a paper fed from the paper-supply portion 1 to an upstream position of the forward-path region 5G, and transports the paper to each of the image forming portions Pc, Pm, Py, Pk in order.

At the upstream end portion of the forward-path region 5G of the belt 5, a second absorbing device 51 is provided. Also provided at the upstream end portion of the return-path region 5R thereof is a first absorbing device 52. The paper is assuredly electrostatically absorbed to and held on the image-transfer belt 5 by the absorbing devices 51, 52.

Figure 2:
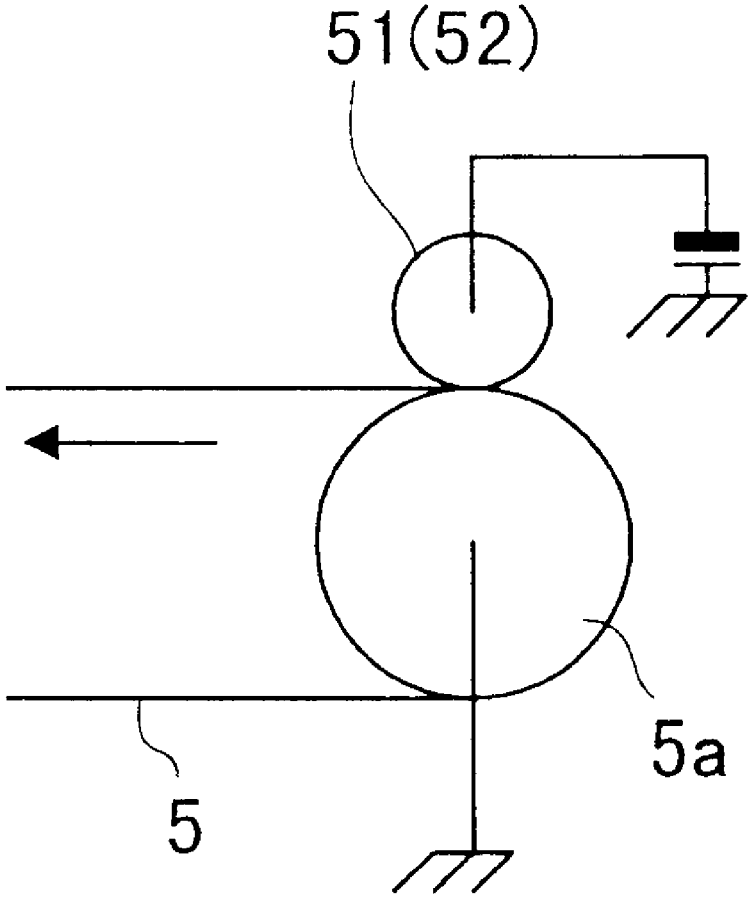
FIG. 2 is a schematic view of a structural example of an absorbing device.

The structure of the absorbing device 51, 52 is not limited to a specific one, and any known structure may be employed. In general, an absorbing device includes a charger disposed at the inner side of the image-transfer belt 5 for passing electric current between the belt 5 and a paper placed thereon and a roller disposed at the outer side of the belt 5 for pressing the paper to the belt 5. However, the absorbing device as shown in FIG. 2, for example, may be employed. The absorbing device consists of an absorbing roller 51(52) which is a DC low-current type (single pole) driving roller (current range: −5 to −100 $\mu$A, voltage range: 0.5 to 5 kV) having an integral charger. Other structures other than the above may also be employed. In FIG. 2, the numeral 5*a* denotes a driving roller for driving the image-transfer belt 5.

At a downstream side of the image forming portion Pk in the forward-path region 5G, an electrostatic removing device 53 is provided for detaching the paper absorbed by the image-transfer belt 5. Provided at the turning portion between the forward-path region 5G and the return-path region 5R of the image-transfer belt 5 are a cleaner 54 for removing toner adhered to the belt 5 and an oil-collecting portion 55 for collecting the oil adhered to the belt 5, which comprise a cleaning device. The cleaning device may be a device for removing unnecessary electric charges of the image-transfer belt 5.

Each of the image forming portions Pc, Pm, Py, Pk, each having substantially the same construction, respectively, includes photosensitive drums 6*c*, 6*m*, 6*y*, 6*k* for holding an image, each driven to rotate in the direction of the arrow shown in FIG. 1. At around each photosensitive drum, an electrostatic charger for uniformly charging each photosensitive drum 6*c*, 6*m*, 6*y*, 6*k*, a developing device for developing electrostatic latent images formed on each photosensitive drum, a transferring charger for transferring a developed toner image on a paper, a cleaner for removing toner remaining on the photosensitive drum, are disposed around each photosensitive drum in order in the rotational direction thereof. In the developing devices of the image forming portions Pc, Pm, Py, Pk, cyan color toner, magenta color toner, yellow color toner and black color toner are stored, respectively. Above the photosensitive drums 6*c*, 6*m*, 6*y*, 6*k*, image exposing devices 7*c*, 7*m*, 7*y*, 7*k* are provided, respectively.

Each image exposing device 7*c*, 7*m*, 7*y*, 7*k* comprises a semiconductor laser, a polygon mirror, an fθ lense, etc. In the image exposing device, a laser beam, which is modulated in accordance with electric digital image signals, scans in the longitudinal direction on each photosensitive drum 6*c*, 6*m*, 6*y*, 6*k* at location between the electrostatic charger and the developing device to expose the drum surface, thereby forming an electrostatic latent image on each photosensitive drum. An image signal corresponding to a cyan color, a magenta color, a yellow color and a black color component of a color image is input into the respective image exposing device 7*c*, 7*m*, 7*y*, 7*k* of the respective image forming portion Pc, Pm, Py, Pk.

The paper-supply portion 1 comprises a plurality of paper-supply trays (for example, cassette type trays) 12*a*, 12*b*, 12*c*, 12*d* for storing different size papers, paper-supply rollers 11*a*, 11*b*, 11*c*, 11*d* each comprising a paper-supply member for supplying a paper one by one through each paper-supply port 1*a*, 1*b*, 1*c*, 1*d* to which the paper-supply tray is set.

Between the paper-supply portion 1 and the image-transfer belt 5, first timing rollers 61 are provided for feeding the paper supplied from the paper-supply portion 1 onto the upstream position of the forward-path region 5G of the image-transfer belt 5 at a certain timing. Provided between the paper inverting portion 9 and the image-transfer belt 5 is second timing rollers 62 for feeding the paper inverted at the paper inverting portion 9 onto the upstream position of the return-path region 5R of the image-transfer belt 5 at a certain timing.

Figure 3:
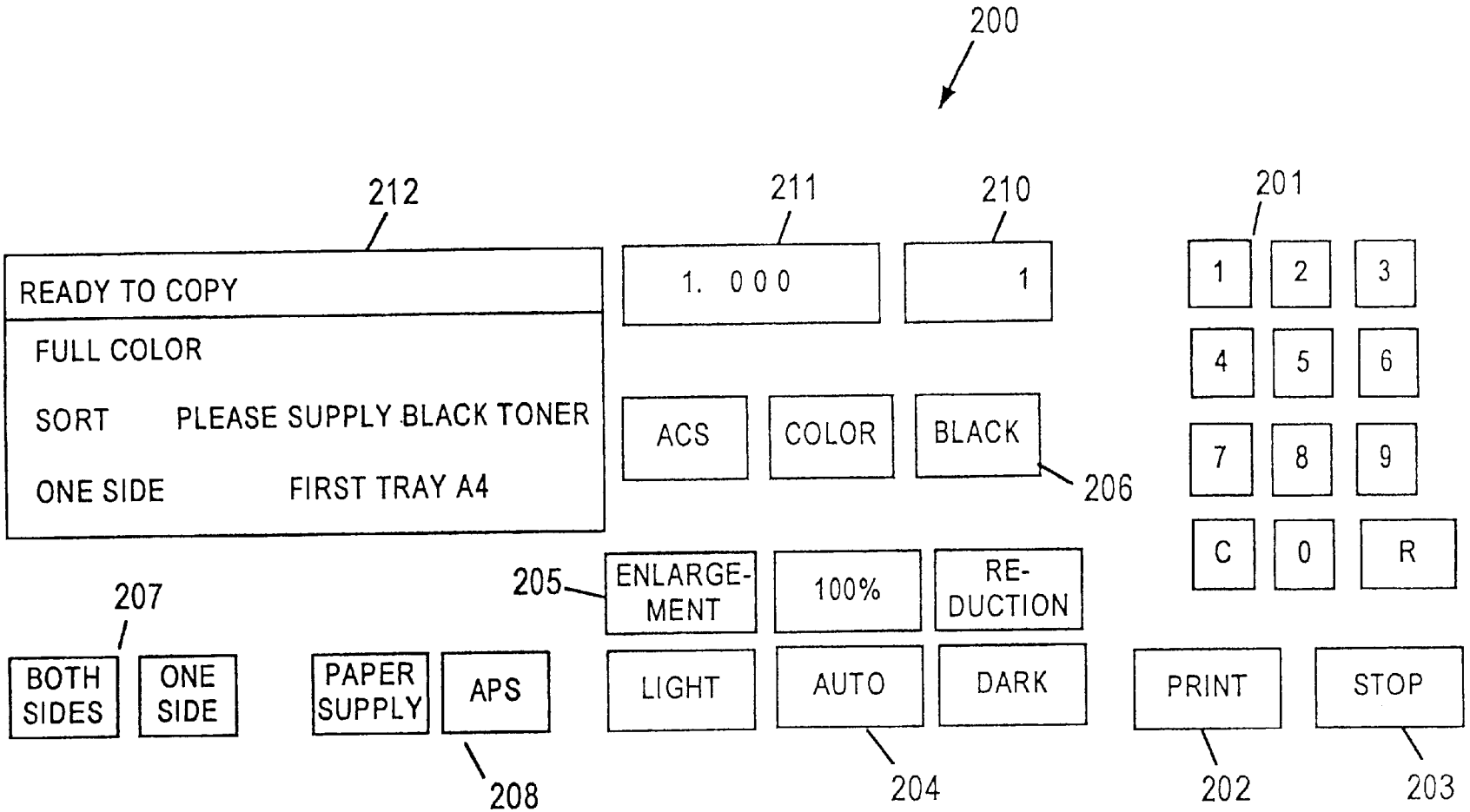
FIG. 3 is a plan view showing a part of an operation panel of the copying machine according to an embodiment of the present invention.

FIG. 3 shows a part of the operation panel 200 of the full color copying machine shown in FIG. 1. As shown in FIG. 3, in this copying machine, the operation panel 200 enables the user to select a certain copy mode from various copy modes, start copying and recognize the set copy mode and the condition of the apparatus from the display.

A copy number setting portion 201 includes a plurality of keys for setting number of copies to be made and clearing the set number.

A key 202 marked as 'PRINT' is used to start copying. A key 203 marked as 'STOP' is used to stop a copying operation. Darkness setting keys 204 are used to adjust the darkness of the image to be copied. Reduce/enlarge rate setting keys 205 are used to set a reduce/enlarge rate of the image to be copied. Color mode selecting keys 206 are used to set whether the image to be copied is printed in full color or only in black.

Copy side selection keys 207 are used to set whether the image to be copied is printed on one side of a paper or on both sides thereof. Tray select keys 208 are used to select one of four paper-supply trays (cassettes).

A copy number display portion 210 displays the number of copies to be made before the copy operation and the number of remaining copies during the copy operation. A reduce/enlarge rate display portion 211 displays the set rate. A liquid crystal display portion 212 is a multi-purpose display portion for displaying the set copy mode, the status of the apparatus and various information other than the information of the number of papers or the reduce/enlarge rate.

Figure 4:
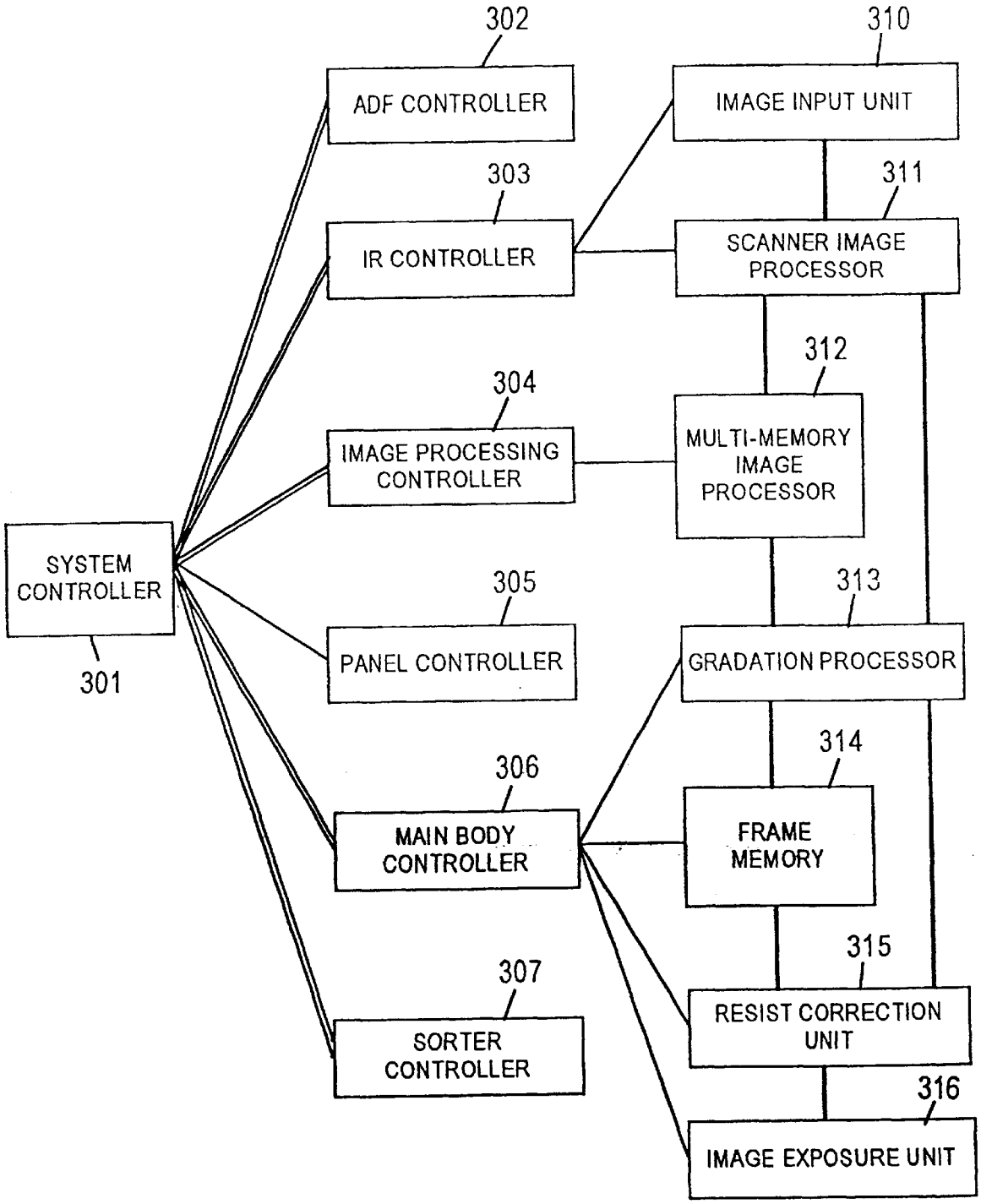
FIG. 4 is a block diagram showing a whole control system of the copying machine according to an embodiment of the present invention.

FIG. 4 is a block diagram showing an overall control of the full color copying machine, such as the one shown in FIGS. 1 to 3.

The full color copying machine includes an image reader (IR) for reading image information on a document as a function of a copying machine, an automatic document feeder (ADF) for automatically feeding a document one by one to an image reading portion of the image reader and the like, in addition to the image forming main portion and the panel portion described in detail with FIGS. 1 to 3. Each driving portion of the above is controlled by the control system shown in FIG. 4, enabling a copy operating which will be mentioned later.

In the control system shown in FIG. 4, a system controller 301 is a control portion for controlling the whole image forming apparatus.

An ADF controller 302 is a control portion which controls the automatic document feeder such that documents are fed one by one to the image reading portion of the image reader and are discharged to a document discharge portion after the completion of the reading of the images.

An IR controller 303 is a control portion for controlling the scanning velocity and position of a scanner for reading an image of a document.

An image processing controller 304 is a control portion which operates a multi-memory image processor 312 depending on a copy sequence or a copy mode. Concretely, the image processing controller 304 controls the recording of an image signal processed by a scanner image processor 311 for every one page of the documents. Furthermore, the image processing controller 304 controls the selecting of an image signal of the document saved for every one page in the order depending on a copy sequence, etc. and the sending of the saved image signal to a gradation processor 313. Furthermore, the image processing controller 304 controls a rotation of an image by 90 degrees or 180 degrees depending on a copy mode, etc.

A panel controller 305 is a control portion which processes and displays key inputs of the operation panel 200 as described in FIG. 3

A main body controller 306 is a control portion which controls the paper-supply portion 1, the fixing device 2, the image-transfer belt 5, the photosensitive drums 6*c*, 6*m*, 6*y*, 6*k* and its peripheral devices, the paper inverting portion 9, the first and second absorbing devices 52, 51, the first and second timing rollers 61, 62, and the like, as described in connection with FIG. 1. The main body controller 306 determines the output value of the first and second absorbing devices 52, 51.

A sorter controller 307 is a control portion which controls the discharge of the papers in the sorter 3, the movement of bins, the position of the shift tray and the stapling operation.

An image input unit 310 includes a sensor portion comprising a CCD, and the like, for reading an image of a document, a circuit portion for digitalizing the signal from the sensor portion. In this embodiment, each component of the color image C, M, Y and K is processed at the same time.

The scanner image processor 311 includes a circuit for reducing/enlarging, shifting, erasing the digitalized image signal depending on a copy mode, etc.

The multi-memory image processor 312 includes a memory for saving image information and a circuit for rotating or reducing/enlarging an image.

The gradation processor 313 includes a circuit which converts the tone data, for example, from eight tones to three tones, corresponding to a circuit.

A frame memory 314 includes a circuit which temporarily saves image signals of a plurality of pages when copying both sides and outputs an image signal of a required page at a required time.

A resist correction unit 315 includes a circuit which delays the image signals corresponding to each C, M, Y and K composition of the color image by a time corresponding to a timing gap of the paper passing below the image forming portions Pc, Pm, Py, Pk in the order. By this circuit, the image signal of each C, M, Y and K component can be processed at the same time between the image input unit 310 and the gradation processor 313 or the frame memory 314.

The image exposure unit 316 corresponds to the reference numerals 7*c*, 7*m*, 7*y*, 7*k* shown in FIG. 1, and comprises a circuit which forms an electrostatic latent image of each C, M, Y and K component on the respective photosensitive drums 6*c*, 6*m*, 6*y*, 6*k* in response to a corresponding image signal.

Next, the copy operation of this copying machine will be explained.

In the image reading portion, image information of a document read by an image reader is electrically digitalized. The electrically digitalized image signal is input into the image exposure devices 7*c*, 7*m*, 7*y*, 7*k* per each component of C, M, Y, K. A laser beam modulated corresponding to the digitalized signal is irradiated onto the photosensitive drum 6*c*, 6*m*, 6*y*, 6*k* for exposing the surface of the drum, which forms electrostatic latent image having each component of C, M, Y, K on each photosensitive drum 6*c*, 6*m*, 6*y*, 6*k*. Furthermore, the electrostatic latent image is developed on each drum 6*c*, 6*m*, 6*y*, 6*k* by a developing device, forming a toner image of each component of C, M, Y, K.

On the other hand, at the paper-supply portion, a paper (recording sheet) is supplied from a certain paper-supply cassette to the first timing rollers 61. The paper is fed on the first position of the image-transfer belt 5 in the forward-path region 5G by the first timing rollers 61 so that the paper coincides with the toner image of each photosensitive drum 6*c*, 6*m*, 6*y*, 6*k*. The paper is electrostatically absorbed and held on the image-transfer belt 5 by the second absorbing device 51. In accordance with the movement of the image-transfer belt 5, the paper passes below each photosensitive drum 6*c*, 6*m*, 6*y*, 6*k* of the image forming portion Pc, Pm, Py, Pk in order and is transported toward the fixing device 2. During the transportation, each toner image of C, Y, M, K component is transferred onto the paper one on another, resulting in a color image.

After the paper passes under the image forming portion Pk, the charged electricity of the paper is removed by the electrostatic removing device 53. After the paper is detached from the belt 5 at the second position, composite images are fixed by the fixing device 2.

In a case of one-side copying, the paper passed the fixing device 2 is discharged to the sorter 3 by the paper inverting portion 9.

In a case of two-sides copying, the paper passed the fixing device 2 is fed to the second timing roller 62 without being discharged to the sorter 3 after being inverted by the paper inverting portion 9. At the image forming portion, a toner image is formed on each photosensitive drum 6*c*, 6*m*, 6*y*, 6*k* corresponding to the image to be formed on the reversed side of the paper.

The paper transported to the second timing roller 62 is fed to the return-path region 5R at the third position on the image-transfer belt 5 by the second timing rollers 62 so that the paper coincides with the toner on each photosensitive drum 6*c*, 6*m*, 6*y*, 6*k*. The paper is electrostatically absorbed to the image-transfer belt 5 by the first absorbing device 52. In place of the second timing rollers, inverting rollers provided in the paper inverting portion 9 may be used for timely feeding the paper to the return-path region 5R of the image-transfer belt 5.

In accordance with the movement of the image-transfer belt 5, the paper is introduced from the return-path region 5R to the forward-path region 5G, and passes each photosensitive drum 6*c*, 6*m*, 6*y*, 6*k* in this order. Thus, a color image is formed on the reverse side thereof, and fixed by the fixing device 2.

This paper having images on both sides thereof is discharged to the sorter 3 by the paper inverting portion 9.

Figure 5:
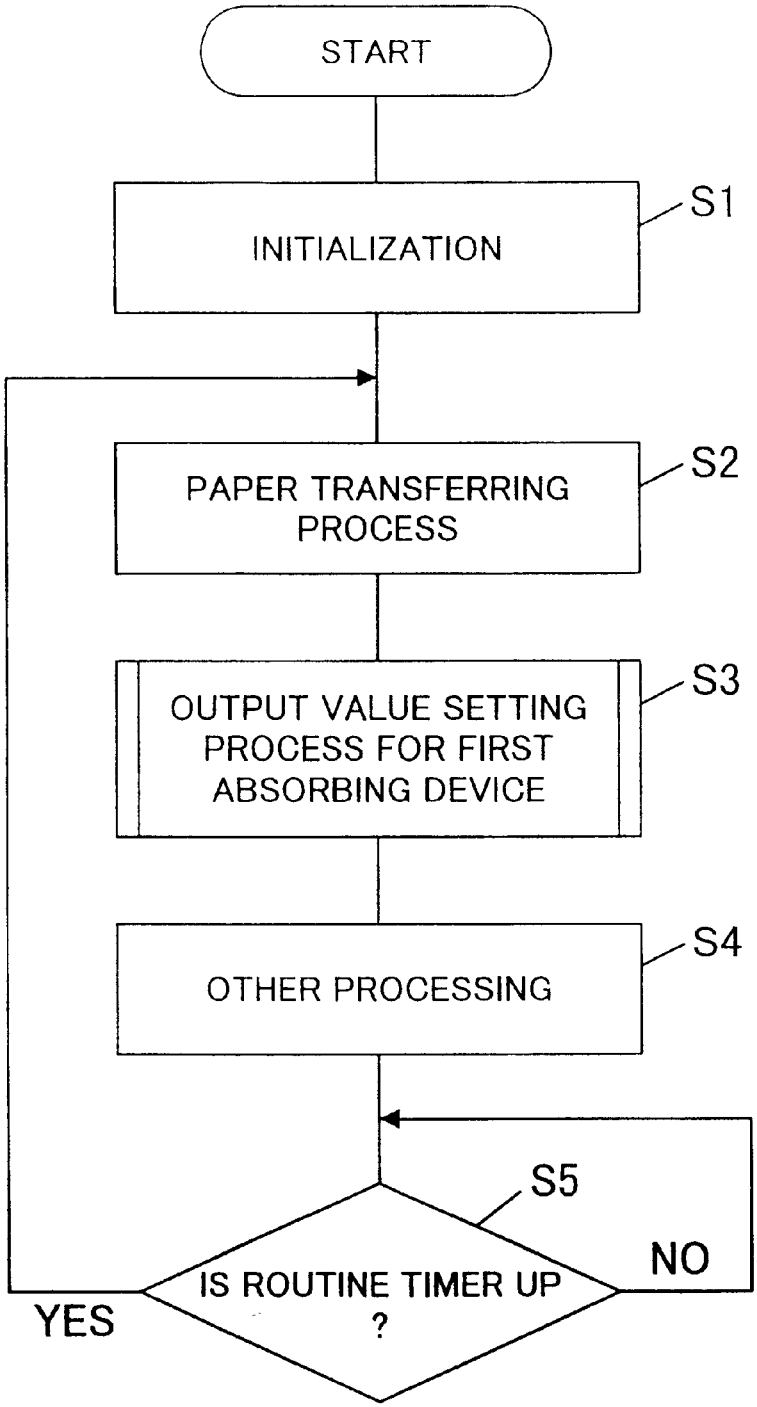
FIG. 5 is a flowchart showing a main routine process executed by the CPU of the main controller.

FIG. 5 is a flowchart of a main routine performed by the CPU of the main body controller 306.

When the power is turned on, and the CPU of the main body controller 306 is activated, a prescribed initialization, which includes initialization of the CPU, the memory, and the I/O, is performed in Step (hereinafter referred to simply as "S") 1. At this time, the values of α, β, γ, and Ts are also set.

In S2 (paper transferring process), a paper is supplied from a selected paper-supply port, and is absorbed on the image-transfer belt by the second absorbing device 51. Thereafter, the paper is detached from the image-transfer belt 5 by the detaching device (electrostatic removing device) 53, and is transported to the fixing device 2. In a case of a two-sides copying, the paper is transported to the inverting portion 9, and is absorbed by the image-transfer belt 5 by the first absorbing device 52 by adjusting the feeding timing by the second timing rollers 62. Thus, the paper transferring process performs a process relating to a paper transport as mentioned above.

In S3 (first absorbing device output value setting process), the output value of the first absorbing device is determined. The actual output operation at the determined value is performed at the paper transferring process in S2 as mentioned above.

In S4 (other processing), processes of the image forming portion which is not related to the present invention, such as a process relating to a communication with the CPU, a process relating to a detection of abnormal operations, input/output from the I/O port, an image forming process control, an image-transfer belt driving control, are performed.

The routine timer in S5 is a timer for performing the operation flow from the paper transferring process in S2 to the other processing in S4 every predetermined time. Every time the routine timer flows, each operation is performed once.

Figure 6:
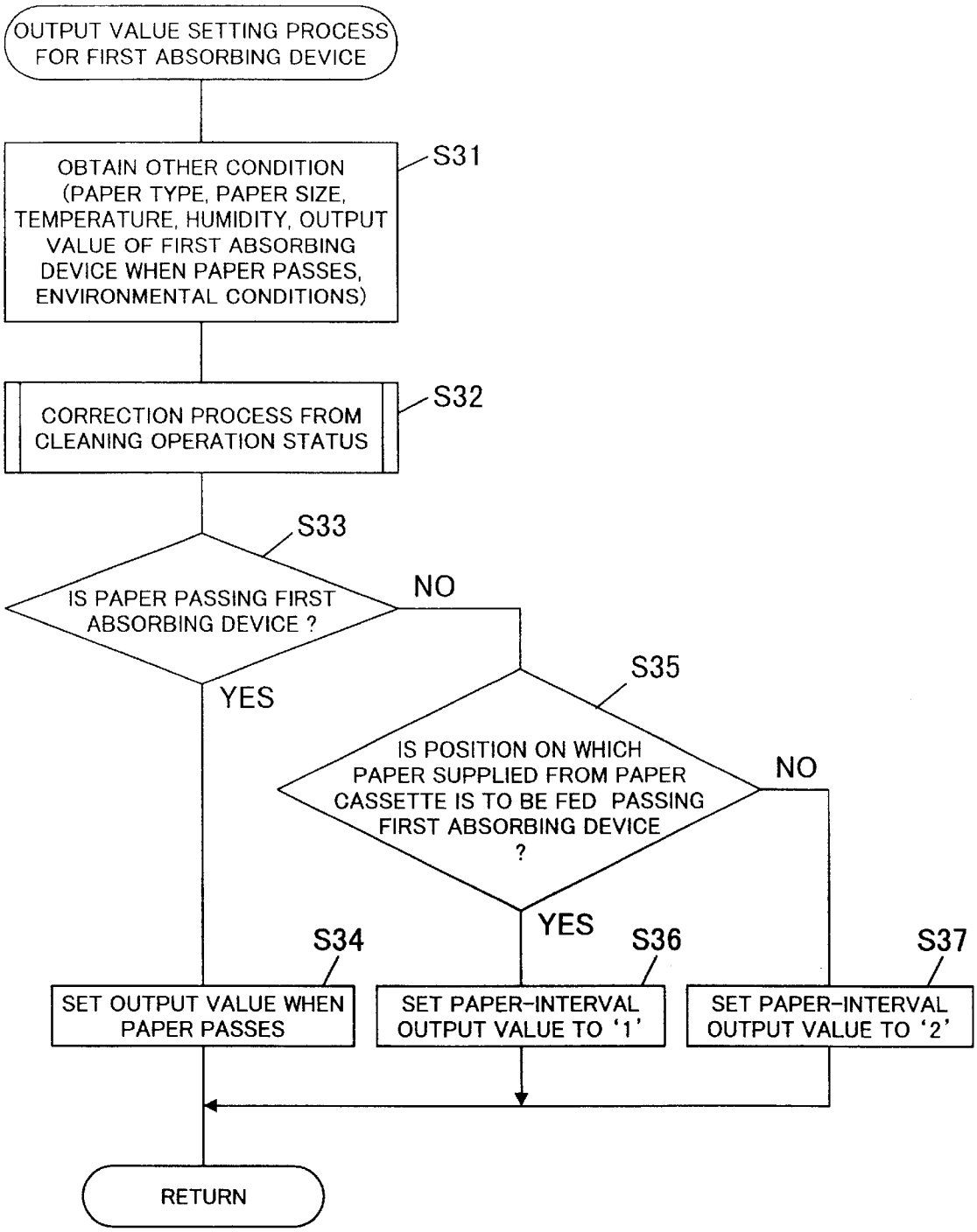
FIG. 6 is a flowchart showing a subroutine of the first absorbing device output value setting process in the flowchart shown in FIG. 5.

FIG. 6 is a flowchart showing a subroutine of the first absorbing device output value setting process S3 shown in FIG. 5.

In this process, in S31, all or at least one of the conditions, such as environmental status including a paper type, paper size, temperature and humidity, an output value when the paper passes the second absorbing device 51, the configuration of the image-transfer belt or the photosensitive drum located from an absorbing device to the next absorbing device at the downstream side, are obtained because of the following reasons. The aforementioned conditions affect the leaking rate of the electric charge given to the image-transfer belt 5 by the first absorbing device 52 changes, which in turn changes the absorbing ability held by the inverted paper which is copied at one side thereof and reached the second absorbing device 51. Furthermore, depending the configuration of the image-transfer belt, etc. (for example, in a case where the belt has a small radius of curvature), the leading edge of the paper may be detached from the image-transfer belt depending on the stiffness of the paper. The paper type, paper size, temperature, humidity, or the like, may be obtained by the operator's input operation or an appropriate sensor.

Next, in S32, a correction process from cleaning operation status is performed. This process will be explained later.

Then, in S33, it is judged whether or not the one-side copied paper is passing the first absorbing device 52. This judgement can be performed by a calculation based on the distance from the second timing rollers 62 to the first absorbing device 52 and the transporting velocity of the paper to be transported from the second timing rollers 62 to the first absorbing device 52, or by a paper detecting sensor.

Figure 7A:
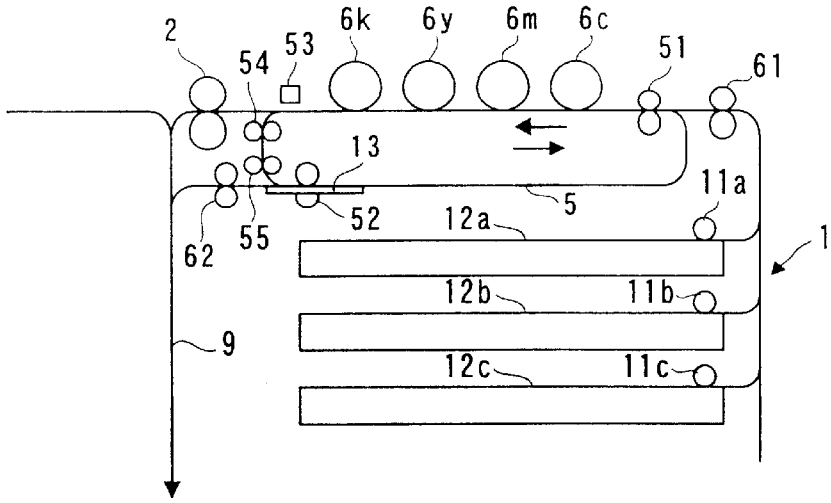
FIGS. 7A, 7B and 7C are an explanatory view showing the relationship between the paper and the transferring belt in deciding the output value of the first absorbing device.
Figure 7B:
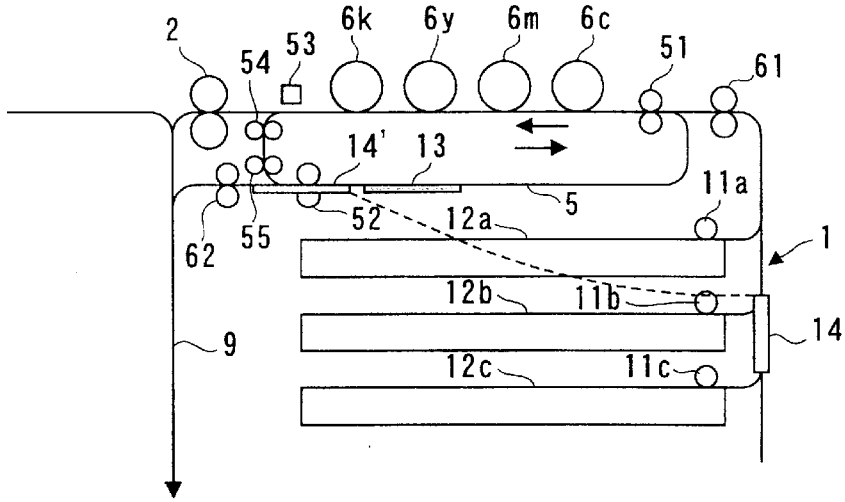
Figure 7C:
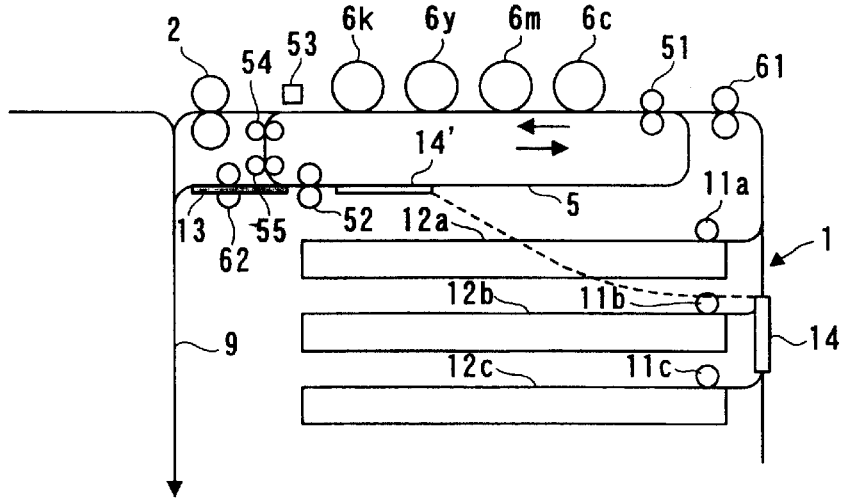

If the one-side copied paper 13 is passing the first absorbing device 52 (Yes, in S33) as shown in FIG. 7(*a*), in S34, the output value at the time when the paper is passing the device 52 is set as the output value of the first absorbing device 52. Then routine returns.

If the paper is not passing the first absorbing device 52 (No, in S33), in S35, it is judged whether or not the position of the image-transfer belt on which the next paper supplied from the paper-supply cassette is to be placed, is passing the first absorbing device 52. This judgement is performed as follows. That is, it is judged that the aforementioned position is passing the first absorbing device 52 on the image-transfer belt 5 if the distance X from the first absorbing device 52 to the second absorbing device 51 in the paper transferring direction satisfies the formula of $|Xp-P|<X<|Xp-P-T|$, wherein P is a pitch between the papers supplied from the cassette 12*a*, 12*b*, 12*c*, 12*d*, T is a paper size in the feeding direction, and Xp is the position of the paper just before a paper ("−" denotes the upstream side of the second absorbing device, and "+" denotes the downstream side thereof).

As shown in FIG. 7(*b*), if the position (range) 14' of the image-transfer belt 5 on which the paper 14 supplied from the paper-supply cassette is to be placed, is passing the first absorbing device 52 (Yes, in S35), in S36, a paper-interval output value 1 is set as an output value of the first absorbing device 52. Then, the routine returns.

On the other hand, as shown in FIG. 7(*c*), if the position (range) 14' of the image-transfer belt 5 on which the paper 14 supplied from the paper-supply cassette is to be placed, is not passing the first absorbing device 52 (No, in S35), in S37, a paper-interval output value 2 is set as an output value of the first absorbing device 52. Then, the routine returns.

The method for deciding the output value of the first absorbing device 52 at the time when the one-side copied paper 13 is passing the first absorbing device 52 to be set in S34, will be explained as follows.

The time t (sec.) taking for the one-side copied paper to reach from the first absorbing device 52 to the second absorbing device 51 can be calculated by t=X/A, wherein A (mm/sec) is a traveling velocity of the image-transfer belt 5, and X (mm) is the distance from the first absorbing device 52 to the second absorbing device 51 in the paper transporting direction. The traveling velocity of the image-transfer belt 5 differs depending on, for example, the paper type. At this time, the output value V1 of the first absorbing device 52 for the inverted one-side copied paper is determined by the formula V1=f(t). The f(t) is a function in accordance with the characteristic of the image-transfer belt 5. The function may be, for example, a linear function, a quadratic function, an $N^{th}$ power function, or the like, depending on the characteristic of the image-transfer belt 5. In other words, the function may be changed depending on the deterioration of the absorbing force due to the leakage of the electric charge from the image-transfer belt 5. Furthermore, since the deterioration of the absorbing force changes depending on the conditions, such as the paper type, the paper size, the temperature, the humidity, or other environmental factors, or the output value of the second absorbing device 51 when the paper is passing the device, an appropriate correction is performed taking into account of these conditions. The correction may be performed by the four basic operations of arithmetic, a correction function such as the aforementioned function, a look-up-table, or other various means.

If it is assumed that the distance X from the first absorbing device 52 to the second absorbing device 51 in the paper transferring direction is 900 mm and that the system velocity is 60 mm/sec, t is 15 seconds (t=15 seconds). If f(t)=2t+5, V is 35 $\mu$A (V=35 $\mu$A).

In a case where the paper is A3 size, by adding 5 as the correction value and the ½ value of the absolute humidity 20% as the correction value if the absolute humidity is 20% Rh, V to be output is represented by the following equation: V=35+5+10=50 ($\mu$A).

As for the paper-interval output value 1 (S36) which is an output value when the position 14' on the image-transfer belt on which the paper supplied from the paper-supply cassette 12*a*, 12*b*, 12*c*, 12*d* is to be placed, is passing the first absorbing device 52, it is preferable to output a voltage which is the same value as the voltage of the second absorbing device 51 and has a polarity opposite to the voltage of the second absorbing device 51. For example, if the output voltage of the second absorbing device 51 is, for example, 100 V, the reverse voltage of −100 v is output. This enables electric charges per unit area on the image-transfer belt 5 to be decreased.

As for the paper-interval output value 2 (S37) which is an output value when the position 14' on the image-transfer belt on which the paper supplied from the paper-supply cassette 12*a*, 12*b*, 12*c*, 12*d* is to be placed, is not passing the first absorbing device 52, in a Tandem type image forming portion as shown in FIG. 1, if each photosensitive drum 6*c*, 6*m*, 6*y*, 6*k* is disposed at drum-peripheral-length intervals, the paper-interval of the image-transfer belt passes the peripheral surface of each photosensitive drum with the same positional relationship. Thus, it is preferable that the paper-interval output value 2 is set to zero.

Figure 8:
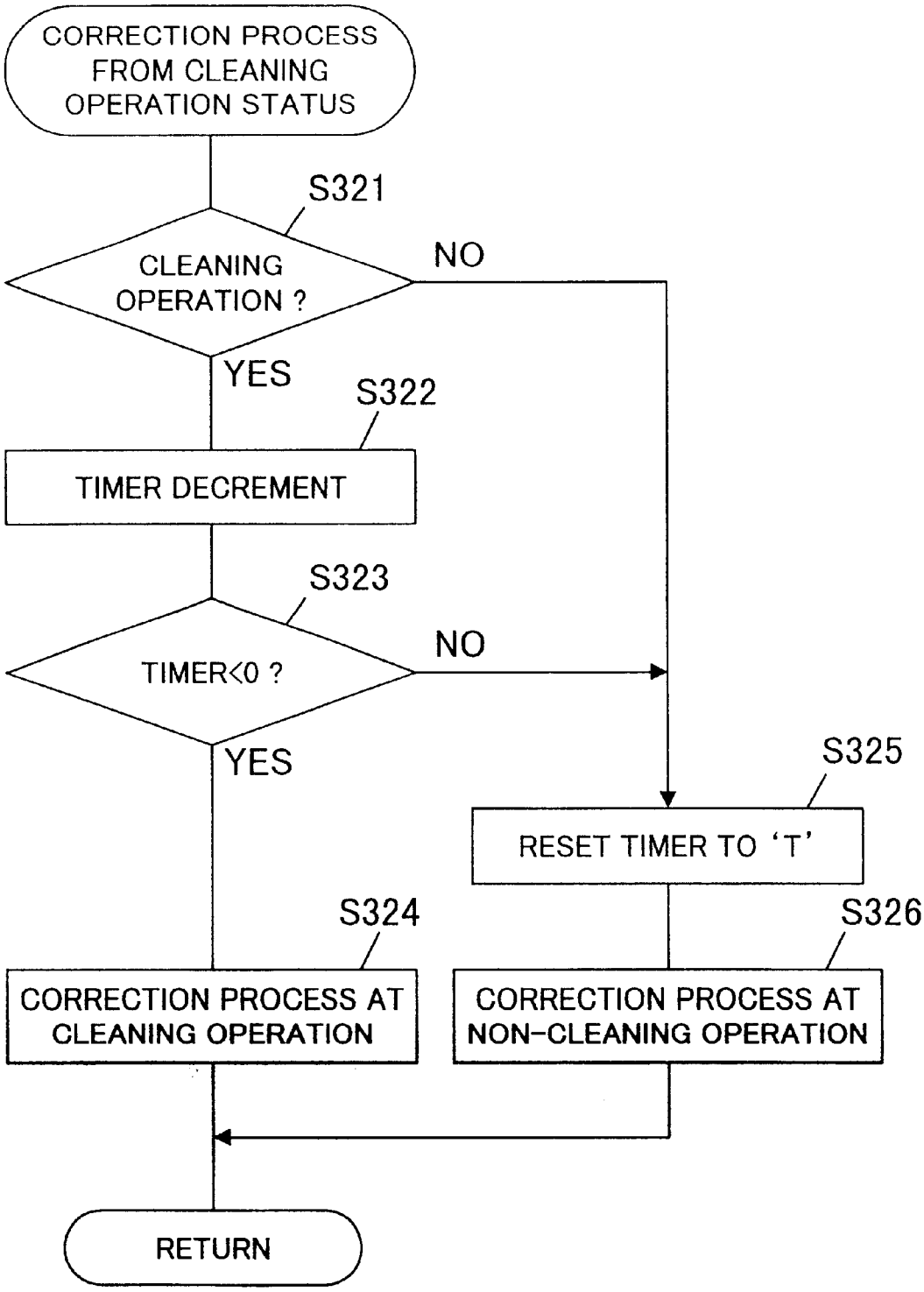
FIG. 8 is a flowchart showing a subroutine of the correction process from the cleaning operation state in the flowchart shown in FIG. 6.

FIG. 8 is a flowchart showing a subroutine of a correction process S32 from the cleaning operation status in the flowchart shown in FIG. 6.

In S321, it is judged whether or not a cleaning operation is being performed, i.e., the cleaner 54 and the oil collecting portion 55 are operating. If the cleaning operation is being performed (Yes, in S321), after the decrement of the timer in S322, it is judged whether or not the timer value is smaller than 1 in S323. This timer functions as a delay timer until the position on the image-transfer belt 5 where the cleaning device is operating reaches the first absorbing device 52. If the timer value becomes smaller than zero, it means that the cleaned position on the image-transfer belt has reached the first absorbing device 52.

If the time value becomes smaller than zero (Yes, in S323), the correction value during the cleaning operation is determined.

On the other hand, if the cleaner 54 and the oil collecting device 55 are not in operation (No, in S321) or if the timer value is zero or more (No, in S323), the timer value is initialized and the correction value when the cleaning operation is not being performed is determined.

It is also considered the correction value in cleaning operation or not in cleaning operation in deciding the output value V of the aforementioned fist absorbing device 52. Therefore, more appropriate output value V can be obtained.

The output value of the second absorbing device 51 is determined based on the time required for the paper to reach the electrostatic removing device 53 since it is necessary to keep enough absorbing force until the paper reaches the electrostatic removing device 53 which is an output portion to the image-transfer belt 5 and is located downstream of the second absorbing device 51.

Figure 9:
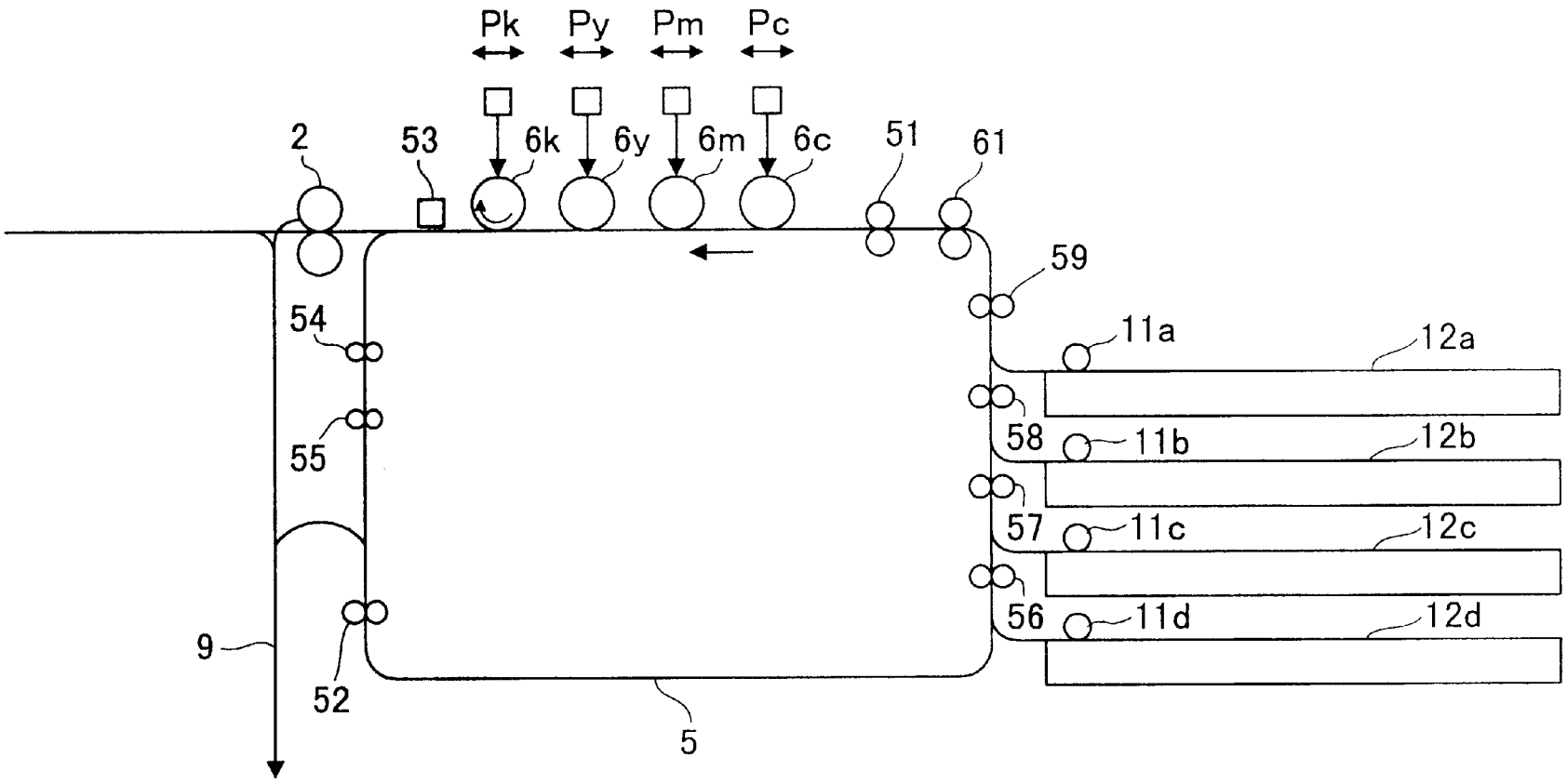
FIG. 9 is a schematic view showing a main portion of the image forming portion of a full-color copying machine according to an another embodiment of the present invention to which the image forming apparatus is applied.
Figure 10:
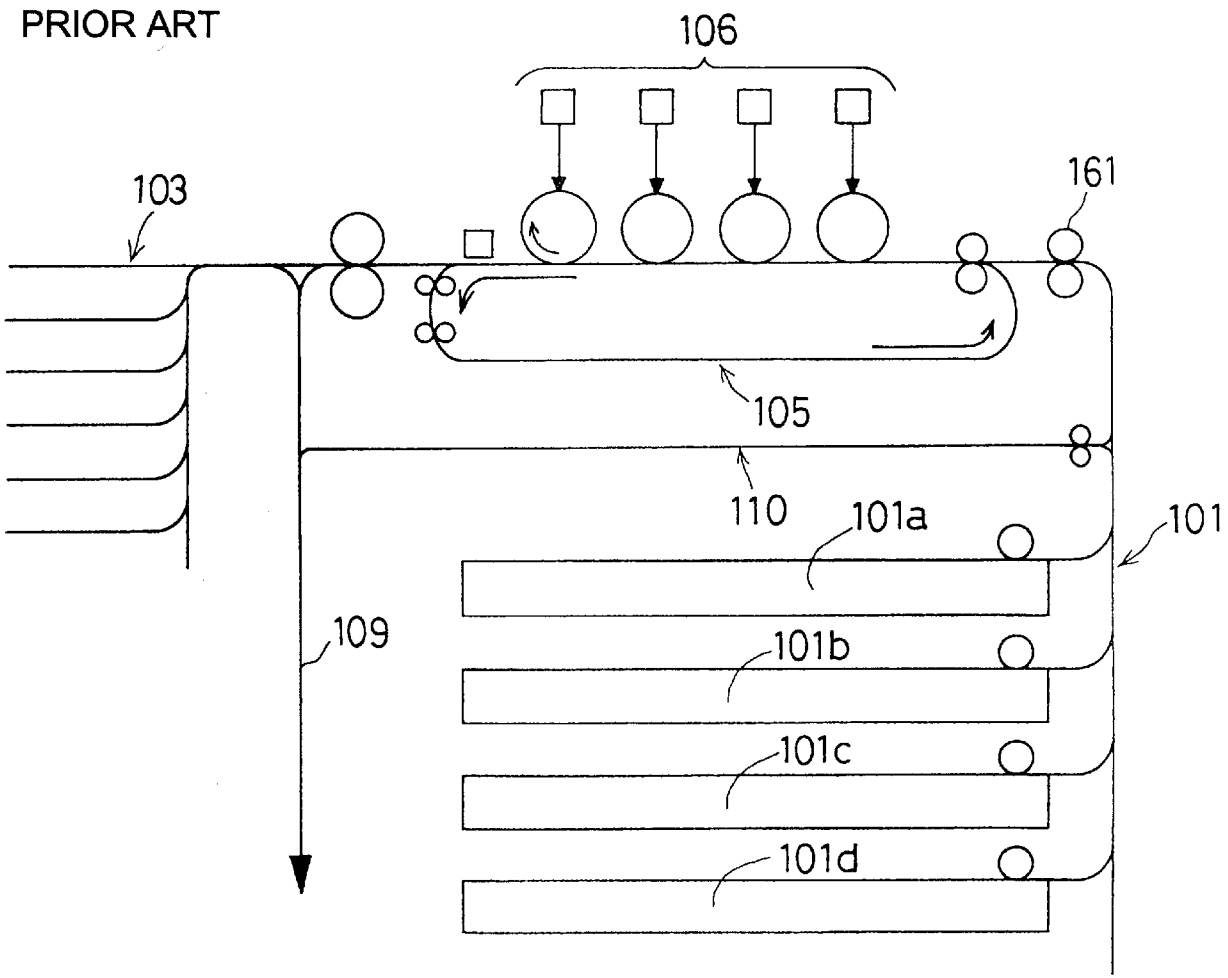
FIG. 10 is a schematic cross-sectional view showing a main portion of an image forming portion according to a conventional full-color copying machine.

In the aforementioned embodiment, two absorbing devices are provided. However, as shown in FIG. 9, it is possible to provide three or more of additional absorbing devices (the embodiment shown in FIG. 9 includes a total of six absorbing devices including the first and second absorbing devices 52, 51). The embodiment shown in FIG. 9 is provided with a long image-transfer belt 5 on which each paper supplied from four paper-supply cassettes 12*a*, 12*b*, 12*c*, 12*d* is directly fed without passing a common paper-supply path and the third, fourth, fifth and sixth absorbing devices 56, 57, 58, 59 each located at the downstream side of each juncture of paper-supply paths from each cassettes 12*a*, 12*b*, 12*c*, 12*d* and the image-transfer belt 5. In this case, the output value of the first absorbing device 52 is determined based on the time required for the paper to reach the next downstream side absorbing device 56. The output value of each of the third, fourth, fifth and sixth absorbing devices 56, 57, 58, 59 is determined based on the time required for the paper to reach the fourth, fifth, sixth and second absorbing devices 57, 58, 59, 51, respectively.

Although the image forming apparatus in which a paper is absorbed on the image-transfer belt 5 is shown as an example, the present invention also can be applied to an image forming apparatus in which a paper is absorbed on an image-transfer drum by a plurality of absorbing devices.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

What is claimed is:

1. An image forming apparatus comprising:

a transferring device equipped with an endless rotating member for transferring a recording sheet while holding the recording sheet on a surface of said rotating member by rotating said rotating member, said transferring device having a first position, a second position and a third position in this order along a rotation path of said rotating member;

an image forming portion for forming an image on the recording sheet being transferred from the first position to the second position by said transferring device, said image forming portion being provided between the first position and the second position so as to face said transferring device;

an inverting portion for receiving the recording sheet having an image formed by said image forming portion and transferred to the second position by the transferring device, inverting the recording sheet, and feeding the inverted recording sheet to said transferring device at the third position; and a cleaning device for cleaning the surface of said rotating member passing between the second position and the third position, wherein said cleaning device is provided between the second position and the third position.

2. An image forming apparatus comprising:

a transferring device equipped with an endless rotating member for transferring a recording sheet while holding the recording sheet on a surface of said rotating member by rotating said rotating member, said transferring device having a first position, a second position and a third position in this order along a rotation path of said rotating member;

an image forming portion for forming an image on the recording sheet being transferred from the first position to the second position by said transferring device, said image forming portion being provided between the first position and the second position so as to face said transferring device;

an inverting portion for receiving the recording sheet having an image formed by said image forming portion and transferred to the second position by the transferring device, inverting the recording sheet, and feeding the inverted recording sheet to said transferring device at the third position; and a fixing device for fixing the image formed on the recording sheet by said image forming portion to the recording sheet, said fixing device being provided between the second position and said inverting position, wherein said inverting portion receives the recording sheet to which the image is fixed by said fixing device.

3. An image forming method for forming imaged on a first side of a recording sheet and a second side which is a reversed side of the first side, the method including the steps of:

a first transferring step for transferring the recording sheet from a first position to a second position on a rotation path of an endless rotating member while holding the recording sheet on a surface of the endless rotating member rotatably driven in a state that the second side is contacted and held on the surface of the endless rotating member;

an inverting step for detaching the recording sheet having the image formed on the first side at said first image forming step from the rotating member at the second position, and inverting the recording sheet;

a holding step for feeding the recording sheet inverted at said inverting step to a third position on the rotation path of the rotating member, and holding the recording sheet on the rotating member with the first side contacted the surface of the rotating member;

a second transferring step for transferring the recording sheet held on the rotating member at said holding step from the third position to the first and second positions in accordance with a rotational movement of the rotating member; and a second image forming step for forming an image on the second sided of the recording sheet being transferred from the first position to the second position at said second transferring step; and a fixing step for fixing the image formed on the first side a the first image forming step to the first side, wherein said fixing step is executed between said first image forming step and said inverting step.

* * * * *